US010069266B2

(12) United States Patent
Hughes

(10) Patent No.: US 10,069,266 B2
(45) Date of Patent: Sep. 4, 2018

(54) ELECTRICAL CONNECTOR HAVING AN ELECTRICALLY INSULATING HOUSING WITH A GROOVE THAT RECEIVES A PROJECTION

(71) Applicant: Cooper Technologies Company, Houston, TX (US)

(72) Inventor: David Charles Hughes, Rubicon, WI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/018,463

(22) Filed: Feb. 8, 2016

(65) Prior Publication Data

US 2017/0229828 A1 Aug. 10, 2017

(51) Int. Cl.
*H01R 13/53* (2006.01)
*H01R 33/945* (2006.01)
*H01R 43/20* (2006.01)

(52) U.S. Cl.
CPC ..... *H01R 33/945* (2013.01); *H01R 43/20* (2013.01)

(58) Field of Classification Search
CPC ..... H01R 13/53; H01R 2103/00; H01R 13/65802; H01R 13/666; H01R 13/6616; H01R 23/7073; H01L 27/0266; H01L 23/552; H01C 7/12
USPC ..... 439/181, 184, 188, 607.27, 620.08, 439/620.21, 660; 361/111, 117, 118
See application file for complete search history.

(56) References Cited

U.S. PATENT DOCUMENTS 4,456,942 A 6/1984 Bronikowski
6,014,306 A 1/2000 Berlovan et al.
7,682,161 B2 * 3/2010 Mao ..... H01R 23/68 439/660
7,909,652 B2 * 3/2011 Yang ..... H01R 12/714 439/660
8,018,707 B2 9/2011 Yaworski et al.
8,157,598 B2 * 4/2012 Niitsu ..... H05K 3/32 439/620.22

(Continued)

OTHER PUBLICATIONS

Thomas & Betts Corporation, Product Guide Protection and Control: Surge Arresters, 2003, 4 pages, available at http://www.tnb.com/pubint/docs/elastimold_surge.pdf (downloaded Feb. 8, 2016).

(Continued)

*Primary Examiner* — Thanh Tam Le
(74) *Attorney, Agent, or Firm* — DiBerardino McGovern IP Group LLC

(57) ABSTRACT

An electrical connector includes an insulating housing. The insulating housing has an inner wall, a first end, and a second end. The inner wall of the insulating housing defines a cavity and a groove, the groove including a groove wall, the groove wall extending from the cavity radially into the insulating housing to a groove depth. The electrical connector also includes an electrical component in the cavity; an electrically conductive shell at an outer surface of the insulating housing; and a plug in the housing, the plug including a body and projection that radially extends from the body, the projection being received in the groove, where the groove wall applies more than 35 pounds (lbs) of force on the plug in a direction that is toward the electrical component.

26 Claims, 9 Drawing Sheets

(56) References Cited

U.S. PATENT DOCUMENTS

| | | | | |
|---|---|---|---|---|
| 8,267,724 | B2 * | 9/2012 | Dodds | H01R 12/724 439/660 |
| 8,517,773 | B2 * | 8/2013 | Lee | H01R 12/716 439/660 |
| 8,556,663 | B2 * | 10/2013 | Geng | H01R 31/06 439/660 |
| 8,715,010 | B2 * | 5/2014 | Wang | H01R 13/7031 439/660 |
| 8,727,811 | B2 * | 5/2014 | Wang | H01R 27/00 439/660 |
| 8,932,083 | B2 * | 1/2015 | Ho | H01R 12/613 439/660 |
| 8,961,230 | B2 * | 2/2015 | Chou | H01R 9/032 439/607.27 |
| 8,979,594 | B2 * | 3/2015 | Tsai | H01R 13/6658 439/660 |
| 9,472,868 | B2 * | 10/2016 | Siebens | H01R 4/646 |
| 2005/0048846 | A1 * | 3/2005 | Suzuki | H01R 23/688 439/660 |
| 2007/0287313 | A1 | 12/2007 | Hughes | |
| 2009/0255106 | A1 | 10/2009 | Hughes et al. | |
| 2010/0098380 | A1 | 4/2010 | Gordon et al. | |
| 2011/0021040 | A1 | 1/2011 | Garb et al. | |
| 2011/0244702 | A1 | 10/2011 | Bertini et al. | |
| 2014/0268471 | A1 | 9/2014 | Luzzi et al. | |

OTHER PUBLICATIONS

Hubbell Power Systems, Hubbell Elbow Arrester, 2011, 4 pages, available at http://www.hubbellpowersystems.com/literature/cable-accessories/CA2038.pdf (downloaded Feb. 8, 2016).

Cooper Power Systems, Surge Arresters: Metal Oxide Varistor Elbow (M.O.V.E.) 235-65, 2011, 8 pages, avilable at http://www.cooperindustries.com/content/dam/public/powersystems/resources/library/235_SurgeArresters/CA235025EN.pdf (downloaded Feb. 8, 2016).

Cooper Power Systems, Surge Arresters: M.O.V.E. DirectConnect Elbow Arrester 235-101, 8 pages, available at http://www.cooperindustries.com/content/dam/public/powersystems/resources/library/235_SurgeArresters/CA235026EN.pdf (downloaded Feb. 8, 2016).

International Search Report and Written Opinion, counterpart PCT Application No. PCT/US2017/016794, dated May 12, 2017, 15 pages total.

* cited by examiner

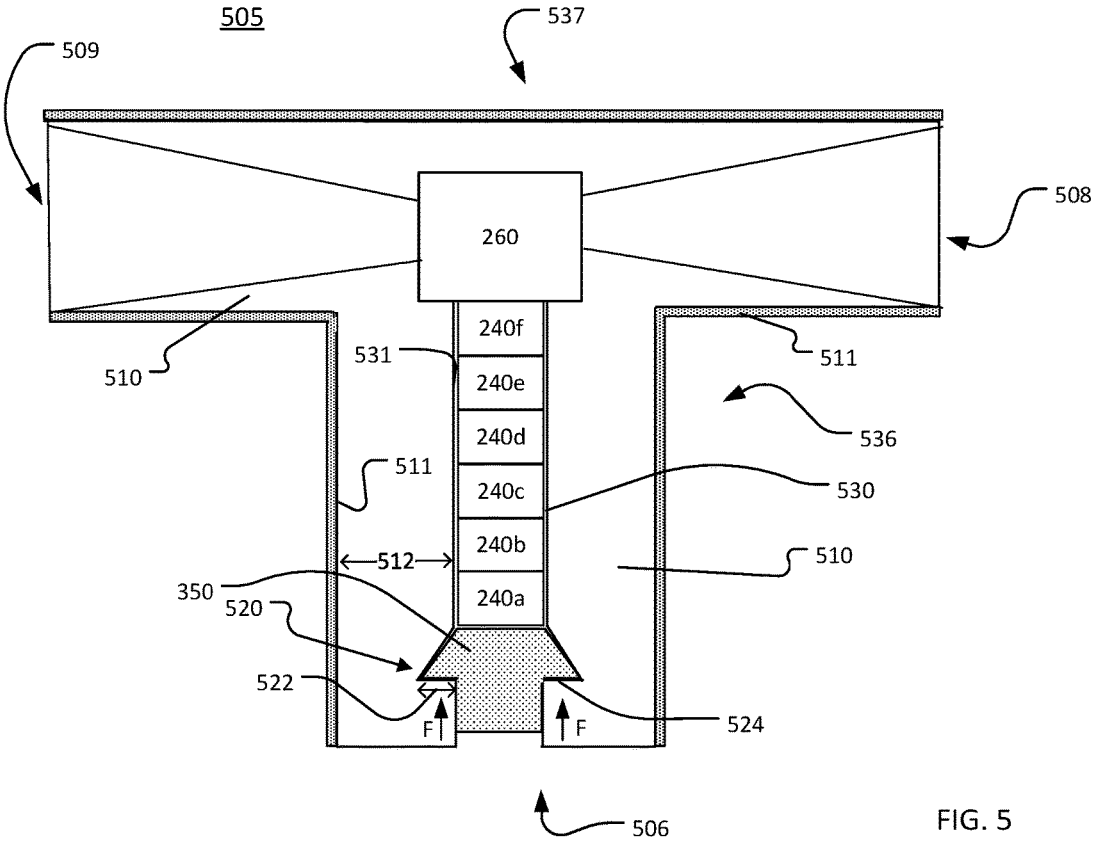
FIG. 5
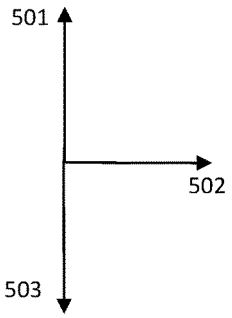

ELECTRICAL CONNECTOR HAVING AN ELECTRICALLY INSULATING HOUSING WITH A GROOVE THAT RECEIVES A PROJECTION

TECHNICAL FIELD

This disclosure relates to an electrical connector for a high-voltage (for example, 10 kilovolts or greater) electrical system.

BACKGROUND

An electrical connector includes an electrical component that provides a low-impedance path to ground during an over-voltage condition. The electrical connector is used to connect electrical transmission and distribution equipment and electrical sources within a high-voltage electrical system.

SUMMARY

In one general aspect, an electrical connector includes an insulating housing. The insulating housing has an inner wall, a first end, and a second end. The inner wall of the insulating housing defines a cavity and a groove, the groove including a groove wall, the groove wall extending from the cavity radially into the insulating housing to a groove depth. The electrical connector also includes an electrical component in the cavity; an electrically conductive shell at an outer surface of the insulating housing; and a plug in the housing, the plug including a body and projection that radially extends from the body, the projection being received in the groove, where the groove wall applies more than 35 pounds (lbs) of force on the plug in a direction that is toward the electrical component.

Implementations may include one or more of the following features. The groove wall may apply more than 70 lbs of force on the plug in the direction. The groove wall may apply between 70 and 200 lbs of force on the plug in the direction.

The projection of the plug may have a partial cone shape. The groove wall may include a radially extending portion of the inner wall of the insulating housing at an end of the groove, the radially extending portion of the inner wall of the insulating housing makes physical contact with the projection of the plug and applies the force to the projection of the plug, and the direction toward the electrical component may include an axial direction.

The electrical component may include a plurality of metal oxide varistors (MOVs), the MOVs being held in direct physical contact with each other by the force. In some implementations, the electrical component lacks an additional mechanism that holds the MOVs in physical contact with each other.

The cavity may include a first cavity portion that extends along a first direction, and a second cavity portion that extends along a second direction, and the first cavity portion and the second cavity portion may be fluidly sealed from each other. The electrical connector also may include an electrical contact that is electrically connected to the electrical component. The electrical contact may be configured to connect to a high-power electrical system. The electrical contact may extend into the second cavity portion and toward the second end of the insulating housing, and the electrical component may be in the first cavity portion.

In some implementations, a semiconductor insert is in the cavity between the first cavity portion and the second cavity portion, and the semiconductive insert fluidly seals the first cavity portion from the second cavity portion.

The insulating housing of the electrical connector may have a thickness in a direction that extends radially from the electrical component, and a ratio of the thickness of the insulating housing to the diameter of the electrical component may be at least 0.4. The ratio of the thickness of the insulating housing to the diameter of the electrical component may be at least 0.5. The ratio of the thickness of the insulating housing to the diameter of the electrical component may be between 0.5 and 0.7.

The insulating housing of the electrical connector may have a thickness in a direction that extends radially from the cavity, and a ratio of the thickness of the insulating housing to the groove depth may be less than 3. In some implementations, the ratio of the thickness of the insulating housing to the groove depth is 2.3-2.6.

The insulating housing may define a plurality of grooves, each groove including a groove wall that extends radially from the cavity into the insulating housing, and a projection of a plug may be received in each groove.

In some implementations, the electrical connector also includes an electrically conductive connection between the plug and the electrically conductive shell.

In another general aspect, a method of assembling an electrical connector includes providing an insulating housing, the insulating housing including a material that expands under applied force and contracts when the applied force is removed, the insulating housing defining a cavity that is open at least at one end of the housing and a groove radially extending from the cavity into the insulating housing; inserting an electrical component into the cavity; inserting a plug into the open end of the insulating housing, the plug including a projection having a first width and a second width; the first width being larger than a diameter of the cavity and larger than the second width; and applying a force to the insulating housing to place the projection of the plug in the groove, the force being in a first direction that is parallel to a longitudinal axis of the cavity and toward the first opening, and the force expanding the insulating housing in the first direction; removing the applied force to allow the insulating housing to contract in a second direction that is away from the first opening such that a radially extending portion of the groove exerts force on the plug in the second direction to hold the electrical component in the cavity, where the radially extending portion of the groove exerts between 35 and 200 pounds (lbs) of force on the plug in the second direction.

Implementations may include one or more of the following features. The insulating housing may be placed inside an electrically conductive shell; and the plug may be electrically connected to the electrically conductive shell through an electrically conductive connection.

In another general aspect, an electrical connector includes an insulating housing including an inner wall, a first end, and a second end, the inner wall of the insulating housing having a thickness and defining a cavity and a groove, the groove including a groove wall extending from the cavity radially to a groove depth; an electrical component in the cavity; an electrically conductive shell at an outer surface of the insulating housing; and a plug in the housing; the plug including a body and projection that radially extends from the body, the projection being received in the groove, where the thickness of the insulating housing is at least 1.3 centimeters, and the ratio of the insulating housing to a radius of the electrical component is at least 0.4.

Implementations may include one or more of the following features. The thickness of the insulating housing may be at least 1.9 centimeters. A ratio of the thickness of the insulating housing to a diameter of the electrical component may be greater than 0.5. A ratio of the thickness of the insulating housing to a diameter of the electrical component may be greater than 0.55.

The electrical component in the cavity may include a plurality of MOVs, and the groove wall may apply a force to the plug in an axial direction, the force holding the MOVs in physical contact with each other.

In another general aspect, an electrical connector includes an insulating housing including an inner wall and an outer surface, the insulating housing having a thickness between the inner wall and the outer surface, the inner wall of the insulating housing defining a cavity, the insulating housing including a material being associated with a resting state and being configured to elongate in a longitudinal direction relative to the resting state; an electrical component in the cavity, the electrical component having a diameter in a direction that is perpendicular to the longitudinal direction; an electrical conductor configured to connect to a high-voltage electrical system; an electrically conductive shell at the outer surface of the insulating housing, the electrically conductive shell being configured to connect to ground; a connection junction electrically connected to the electrical component and to the electrical conductor, the insulating housing being between the connection junction and the electrically conductive shell; and an electrically conductive plug in the housing, the plug being electrically connected to the electrical component and being configured to connect to ground, where a portion of the housing is elongated at least 10% more than the resting state, and a ratio of the thickness of the housing to the diameter of the electrical component is greater than 0.4.

Implementations may include one or more of the following features. The plug may apply a force that is greater than 35 lbs on the electrical component, the applied force being toward the semiconductive insert.

The electrical component includes a plurality of MOVs, the MOVs being held in direct physical contact with each other by the force, and the electrical component may lack an additional mechanism that holds the MOVs to each other.

The ratio of the thickness of the housing to the diameter of the electrical component may be greater than 0.5. The ratio of the thickness of the housing to the diameter of the electrical component may be between 0.55 and 0.65.

Implementations of any of the described techniques above may include an apparatus, a system, an electrical connector, a device for protecting a power system, and/or a method. The details of one or more implementations are set forth in the accompanying drawings and the description below. Other features will be apparent from the description and drawings, and from the claims.

DRAWING DESCRIPTION

FIG. 1 is a block diagram of an example electrical system that includes an electrical connector.

FIG. 2A a side cross-sectional block diagram of an example insulating housing for an electrical connector.

FIG. 5 is a side cross-sectional block diagram of another example electrical connector.

DETAILED DESCRIPTION

Figure 1:
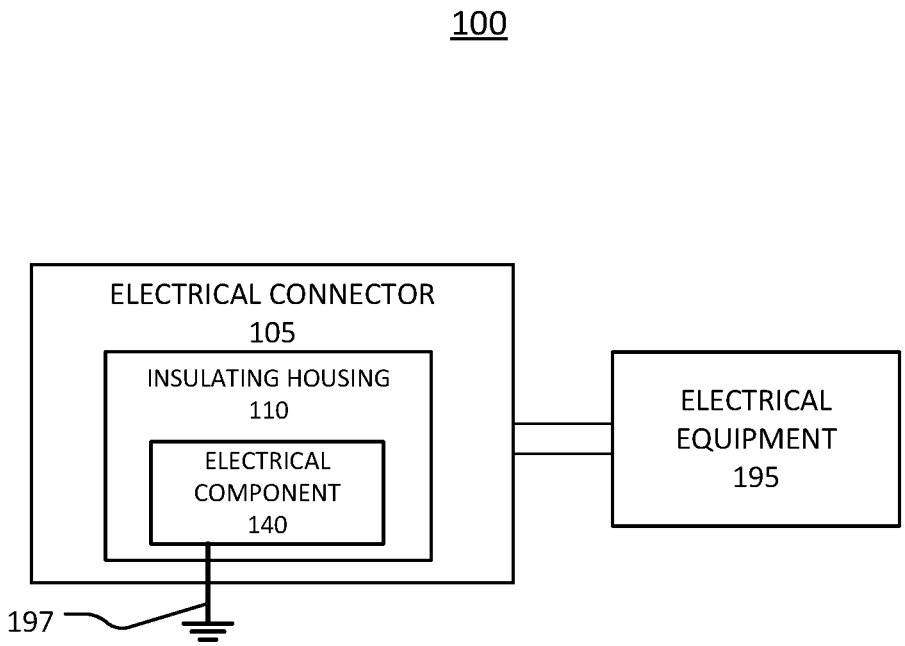

Referring to FIG. 1, a block diagram of an example electrical system 100 is shown. The system 100 includes an electrical connector 105, which is connected between electrical equipment 195 and ground 197. The electrical connector 105 protects the electrical equipment 195 from electrical voltage surges. The electrical equipment 195 may be, for example, a transformer, a power source, or an electrical system that includes a collection of such devices. The electrical connector 105 may be used in a high-power electrical system, for example, a system that operates at greater than 10 kilovolts (kV) or between 12 and 36 kV.

The electrical connector 105 includes an insulating housing 110 and an electrical component 140 in the insulating housing 110. The electrical component 140 has a high impedance under normal operating conditions. As the voltage across the electrical component 140 increases, the impedance of the electrical component 140 decreases. At voltages above a breakdown voltage associated with the material of the electrical component 140, the impedance of the electrical component 140 is negligible and the electrical component 140 forms a low impedance current path from the electrical equipment 195 to ground 197. The electrical component 140 is selected such that when the voltage across the electrical component 140 increases beyond the maximum safe voltage for the electrical equipment 195 (such as during an over-voltage condition), the electrical component 140 provides a low impedance current path to ground 197 to conduct excess current away from the electrical equipment 195.

As discussed below, the insulating housing 110 is configured to apply a longitudinally compressive force to the electrical component 140 such that the electrical component 140 works properly and as expected without using additional compression mechanisms such as wraps, adhesives or bonding agents, or springs. Additionally; the insulating housing 110 has a thickness that helps the electrical connector 105 maintain its shape during use.

Figure 2A:
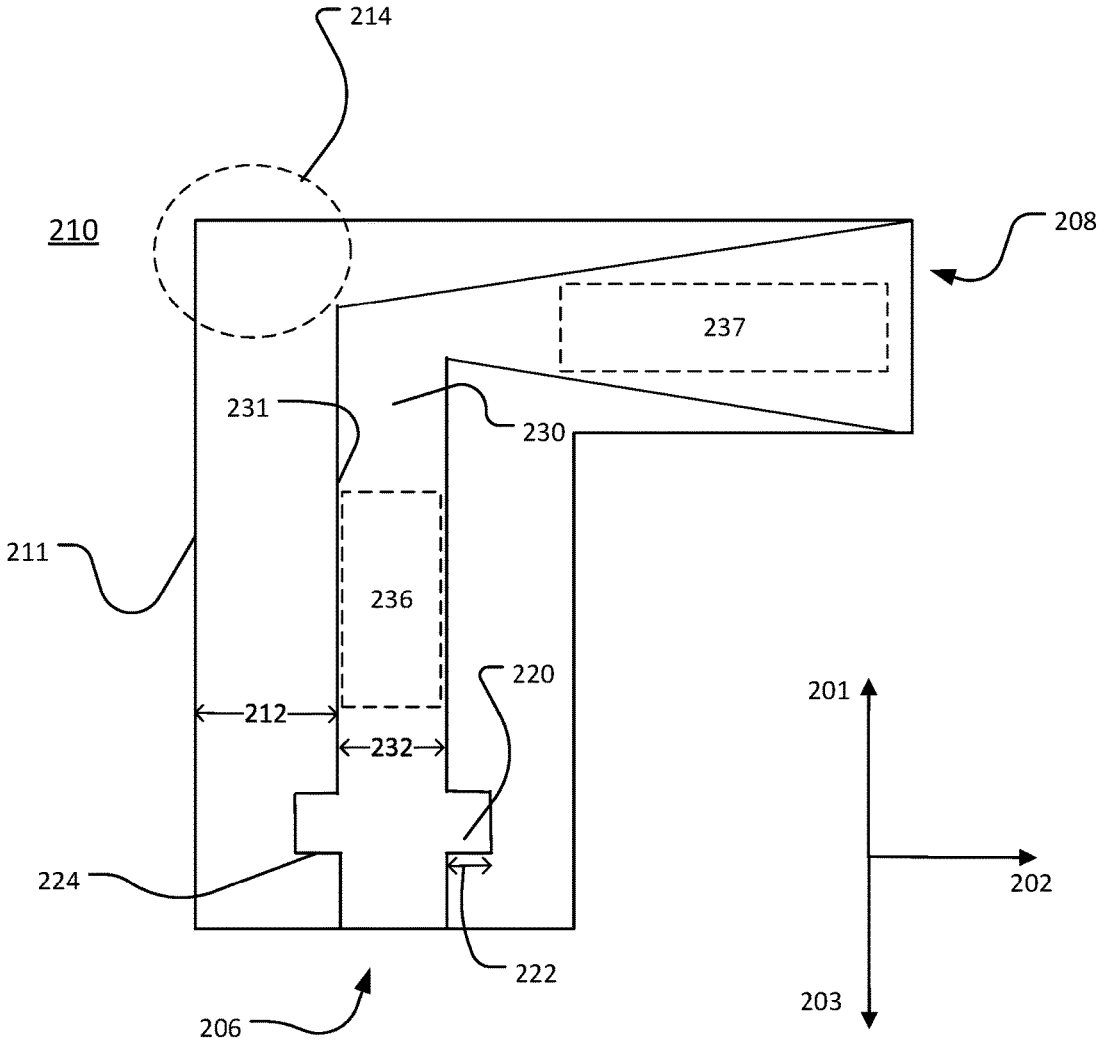
FIG. 2B is a side cross-sectional block diagram of an example electrical connector that includes the insulating housing of FIG. 2A.
FIG. 2C is a side cross-sectional block diagram of an example plug for the electrical connector of FIG. 2B.
FIG. 2D is a block diagram of a contact assembly for the electrical connector of FIG. 2B.
FIG. 2E is a side cross-sectional block diagram of an example electrical connector that includes the insulating housing of FIG. 2A.
Figure 2B:
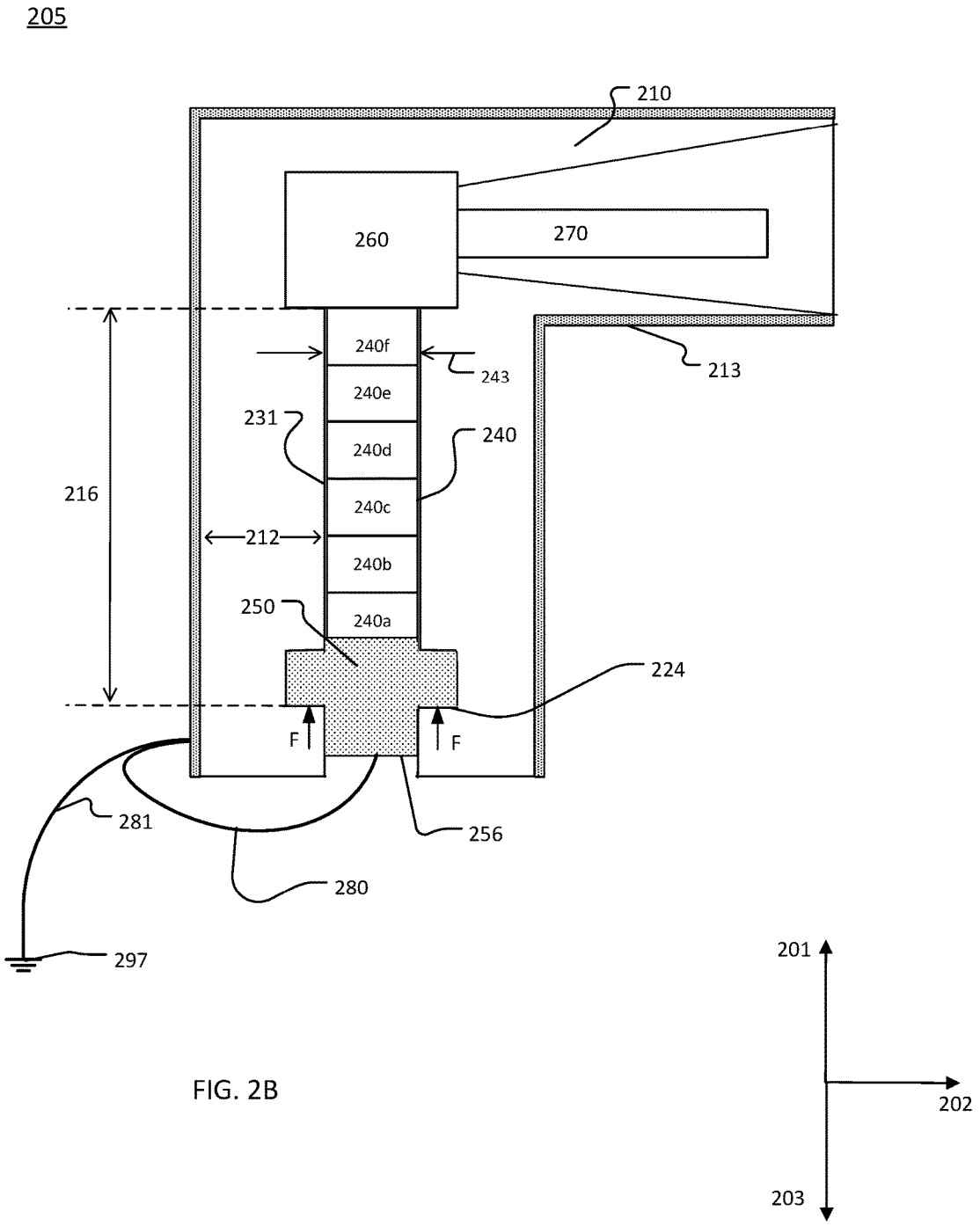

Referring to FIG. 2A, a side cross-sectional block diagram of an example insulating housing 210 is shown. FIG. 2B is a side cross-sectional block diagram of an example electrical connector 205 that includes the insulating housing 210. The insulating housing 210 has a first end 206, a second end 208, an outer surface 211, and an inner wall 231. The inner wall 231 defines a groove 220 and a cavity 230.

The groove 220 is a notch, depression, hole, opening, or other space defined by the inner wall 231 of the insulating housing 210. The groove 220 is open to the cavity 230 and extends radially away from the cavity 230 into the insulating housing 210 to a groove depth 222. A portion of the inner wall 231 forms a groove wall 224 that extends radially to the groove depth 222. The cavity 230 includes a first portion 236, which extends along a direction 201, and a second portion 237, which extends along a direction 202. In the example of FIGS. 2A and 2B, the directions 201 and 202 are perpendicular to each other. However, in other implementations, the directions 201 and 202 may be non-perpendicular to each other.

The insulating housing 210 has a thickness 212, in the example of FIG. 2A, the thickness 212 is the distance between the inner wall 231 of the cavity 230 and the outer surface 211 of the insulating housing 210 along the direction 202. As shown in FIG. 2A, the thickness 212 is at a portion of the insulating housing 210 that does not include the groove 220. The cavity 230 has a diameter 232 in the direction 202.

Figure 2C:
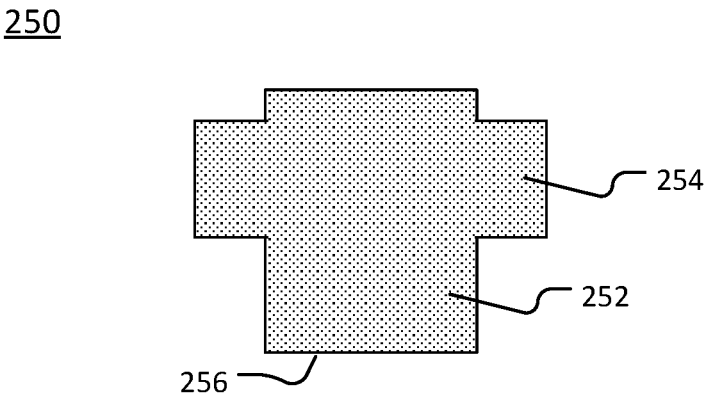
Figure 2D:
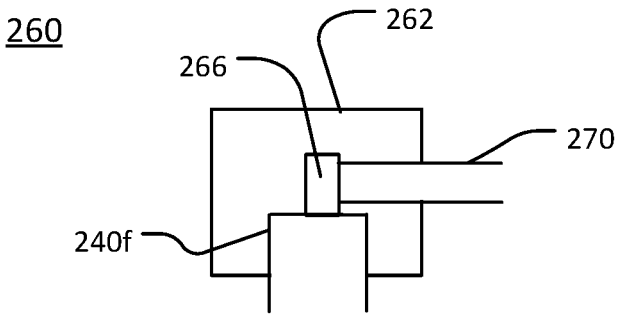

Referring also to FIGS. 2B-2D, an electrical component 240 is received in the first portion 236 of the cavity 230. The electrical component 240 has an outer diameter 243. The outer diameter 243 is similar to the diameter 232 of the cavity 230, with the diameter 232 of the cavity 230 being slightly smaller than the outer diameter 243 of the electrical component 240. Due to this configuration, the insulating housing 210 applies a radially compressive force, which is directed radially inward from the inner wall 231, on the electrical component 240. This radially compressive force results in an interference fit between the electrical component 240 and the inner wall 231 the insulating housing 210. The interference fit helps to hold the electrical component 240 in the insulating housing 210. Additionally, the interference fit may eliminate air that could otherwise be in a space between the electrical component 240 and the inner wall 231.

Further, as discussed in greater detail below, the thickness 212 is relatively large, and the ratio of the thickness 212 to the diameter 243 of the electrical component 240 is also relatively large (for example, 0.4 or greater). The relatively large thickness 212 and ratio results in a larger radially compressive force being applied to the electrical component 240, as well as a greater longitudinal force being applied to the electrical component 240, than is possible with a thinner housing. The relatively thick housing and high ratio of the thickness 212 to the diameter 243 of the electrical component 240 also helps the electrical connector 205 maintain shape during use, including during over-voltage conditions.

The electrical component 240 is electrically connected through a contact assembly 260 to an electrical conductor 270, which extends along the direction 202 in the second portion 237 of the cavity. The electrical conductor 270 is used to connect the electrical connector 205 to an electrical system, such as the electrical equipment 195 of FIG. 1. The electrical system to which the electrical connector 205 is connected is a high-voltage electrical system that operates at, for example, 10 kV or more.

In the example of FIG. 2B, the electrical component 240 is a plurality of metal oxide varistors (MOV) blocks 240*a*-240*f*. Each of the MOV blocks 240*a*-240*f* have an impedance close to zero when the voltage across the MOV block exceeds the breakdown voltage of the material from which the MOV block is formed. To ensure that the MOV blocks 240*a*-240*f* are held in contact with each other so that the electrical component 240 conducts current from the electrical conductor 270 to ground 297 during an over-voltage condition, a force F is applied to the electrical component 240 in the direction 201. As discussed below, the force F arises from a cooperation between a plug 250 (FIG. 2C) and the insulating housing 210.

The configuration of the insulating housing 210 and the plug 250 allows the force F to be sufficiently large such that the MOV blocks 240*a*-2'40*f* are compressed in the direction 201 and held in contact with each other and with the contact assembly 260 without any additional compression mechanisms. For example, the ratio of the thickness 212 to the groove depth 222 enables the groove wall 224 and the projection 254 to cooperate to provide a force on MOV blocks 240*a*-240*f* of the electrical component 240 in the direction 201 that is sufficiently strong to hold the MOV blocks 240*a*-240*f* in contact without additional compression mechanisms (for example, springs, adhesives, and/or a fiberglass wrap). Thus, the electrical connector 205 may contain fewer parts than a typical electrical connector making the electrical connector 205 less expensive to manufacture and less prone to failure.

The plug 250 includes a body 252, and a projection 254, which extends radially from the body 252. The plug 250 is made of a material that conducts electricity. For example, the plug 250 may be made of a metallic material, such as brass. The projection 254 is received in the groove 220 and a portion of the projection 254 contacts the groove wall 224. The insulating housing 210 is made from a non-conductive material that is capable of expanding and contracting along the direction 201. When the projection 254 is in the groove 220, the contraction of the insulating housing 210 in the direction 201 causes the groove wall 224 to apply force to the projection 254 in the direction 201. The force on the projection 254 results in the body 252 also applying force to the electrical component 240 in the direction 201.

To apply the force to the electrical component 240 in the direction 201, the insulating housing 210 is elongated in the direction 203, and the plug 250 is inserted into the insulating housing 210 by stretching the housing 210 in the direction 203 and over the projection 254 of the plug 250. After the force is removed, the insulating housing 210 contracts in the direction 201, and the projection 254 becomes seated in the groove 220. However, the positioning of the groove 220 is such that even after the housing 210 contracts in the direction 201 and the projection 254 is seated in the groove, the housing 210 remains elongated as compared to the original, resting state of the insulating housing 210 (a state prior to any elongating force being applied in the direction 203). Because the portion 216 remains somewhat elongated, the portion 216 also continues to experience an opposing compressive effect, resulting in the groove wall 224 applying the force to the projection 254 in the direction 201. The force F on the projection 254 is such that the electrical component 240 operates properly without additional longitudinal compression mechanisms. The force F may be, for example, 35 pounds (155 Newtons) or greater.

To ensure that the force F is sufficiently large, a portion of the housing between the contact assembly 260 and the groove wall 224 (labeled as 216) may be elongated by, for example, 25% more than the resting state of this portion of the housing. In other words, the portion 216 of the housing remains elongated by 25% than its original, resting state after the electrical connector 205 is assembled and while the electrical connector 205 is in use. In other examples, the portion 216 may be elongated between 10% and 30% more than the resting state during use.

The relatively large groove depth 222 and the relatively large thickness 212 of the is housing 210 allow the housing 210 to be stretched in the direction 203 and to remain sufficiently elongated after the electrical connector 205 is assembled. Having a relatively large groove depth 222, corresponds to having a large groove wall 224, thus providing a larger surface area to hold the projection 254. As compared to a design with a smaller groove depth, or no groove that extends radially outward from the cavity 230 and into the housing 210, the groove depth 222, of the electrical connector 205 results in a configuration in which the plug 250 remains in the groove 220 without falling out as the housing 210 contracts in the direction 201. Additionally, the thickness 212 of the housing 210 is relatively large such that the groove depth 222 does not extend so far into the housing 210 that the presence of the groove 220 would negatively impact the integrity (for example, the shape and/or rigidity) of the housing 210.

To enable the insulating housing 210 and the plug 250 to apply a sufficient amount of force to the electrical component 240, the groove depth 222 and the thickness 212 are relatively large, and the ratio of the housing thickness 212 to the groove depth 222 is also relatively large. For example, the ratio of the housing thickness 212 to the groove depth 222 may be 2.6 to 3.2. The groove depth 222 may be, for example, 0.7-0.8 centimeters (cm). The insulating housing thickness 212 may be, for example, at least 1.3 cm. In some implementations, the thickness 212 is between 1.3 and 2 cm. In other implementations, the thickness is between 1.95 and 2 cm, and may be, for example, 1.96 cm. The ratio of the thickness 212 of the housing 210 to the outer diameter 243 of the electrical component 240 may be, for example, between 0.5 and 0.7, between 0.58 and 0.60, or 0.59. These configurations allow the groove wall 224 to apply, for example, 35 pounds (lbs), 50 lbs or more, 70 to 200 lbs, 100 to 200 lbs, or more than 200 lbs of force on the projection 254 along the direction 201.

Additionally, the relatively large thickness 212 of the insulating housing 10 results in an insulating housing 210 that is more rigid and sturdy than a housing with a smaller thickness. The thickness 212 of the housing 210 allows the electrical connector 205 to retain its shape (with portions of the housing 210 extending along the directions 201 and 202) during use, including during over-voltage conditions during which the electrical component 240 provides a low-impedance current path. When the electrical component 240 forms a low-impedance current path, large currents (for example, currents on the order of 10,000 Amperes) pass through the electrical component 240, and plasma and hot gasses may form in the first portion 236 of the cavity 230. The plasma and hot gasses may escape from the end 206. Because the electrical connector 205 retains its shape during use, plasma and hot gasses that escape from the end 206 are directed primarily along the direction 203 (which is opposite to the direction 201). In this way, the direction of escaping plasma and hot gasses is known and fairly predictable as compared to an electrical connector that experiences substantial flexing or shape changes in which portions of the electrical connector intended to extend along different directions may instead extend along the same direction during use.

In the example of FIGS. 2A and 2B, the thickness 212 is measured from the inner wall 231 to the outer surface 211 in the direction 202. However, the insulating housing 210 also may be made relatively thick in other regions of the insulating housing 210. For example, the thickness of the insulating housing 210 from the inner wall 231 to the outer surface 211 in a radial direction at a region 214, which is a region of the housing 210 where a portion of the housing 210 that extends in the direction 201 and a portion of the housing 210 that extends in the direction 202 meet, also may have a thickness of 1.3 cm or greater.

As discussed above, the electrical conductor 270 and the electrical component 240 are electrically connected to each other by the contact assembly 260. FIG. 2D is a block diagram of the contact assembly 260. The contact assembly 260 includes a semiconductive insert 262, which substantially surrounds or partially surrounds a connection junction 266. The electrical conductor 270 and the electrical component 240 are mounted in and are physically connected at the junction 266, which may be made out of a metallic material such as, for example, brass. The semiconductive insert 262 may be a faraday cage, and the semiconductive insert 262 may be made of the same material as the conductive shell 213. The components of the contact assembly 260, such as the connection junction 266, may be at the high operating voltages (for example, 12-36 kV) of the electrical equipment to which the electrical conductor 270 is connected. Because the insulating housing 210 does not conduct electricity, the insulating housing 210 forms an electrically insulating barrier between the high voltage components in the contact assembly 260 and the conductive shell 213.

In some implementations, the contact assembly 260 also fluidly seals the first portion 236 of the cavity 230 from the second portion 237 of the cavity 230. In these implementations, plasma and hot gasses that may form in the first portion 236 cannot flow into the second portion 237. To seal the first portion 236 from the second portion 237, the semiconductive insert 262 and the junction 266 are connected to each other or joined to each other such that fluid cannot flow through the connection. The semiconductive insert 262 and the junction 266 may be connected to each other by, for example, an adhesive bond that is directly between the junction 266 and the semiconductive insert 262. In other examples, an O-ring seal may be placed on the electrical conductor 270 to fluidly seal the first portion 236 of the cavity 230 from the second portion 237 of the cavity 230.

The electrical connector 205 also includes a conductive shell 213, which surrounds the insulating housing 210. The conductive shell 213 is electrically conductive and may be made of, for example, a conductive elastomeric material. For example, the conductive shell 213 may be rubber material that includes an electrically conductive component, such as ethylene propylene diene monomer (EPDM) loaded with carbon. The conductive shell 213 may be made of any material that conducts electricity.

In some implementations, an end 256 of the plug 250 is electrically connected to the conductive shell 213 through a conductive connection 280. The conductive connection 280 may be, for example, a metallic wire. In the example of FIG. 2B, the conductive shell 213 is connected to ground 297 through a wire 281. The wire 281 may be, for example, a braided copper wire capable of conducting large amounts of current (for example, 10,000 Amperes or more). Thus, the plug 250 is connected to ground 297 through the conductive connection 280 and the wire 281. In an over-voltage condition, current is conducted through the electrical component 240 and the plug 250 to ground 297 through the conductive connection 280 and the wire 281. In other implementations, the conductive connection 280 may connect directly to ground 297 without being connected to the conductive shell 213, with the conductive shell 213 being connected to ground 297 separately.

Figure 2E:
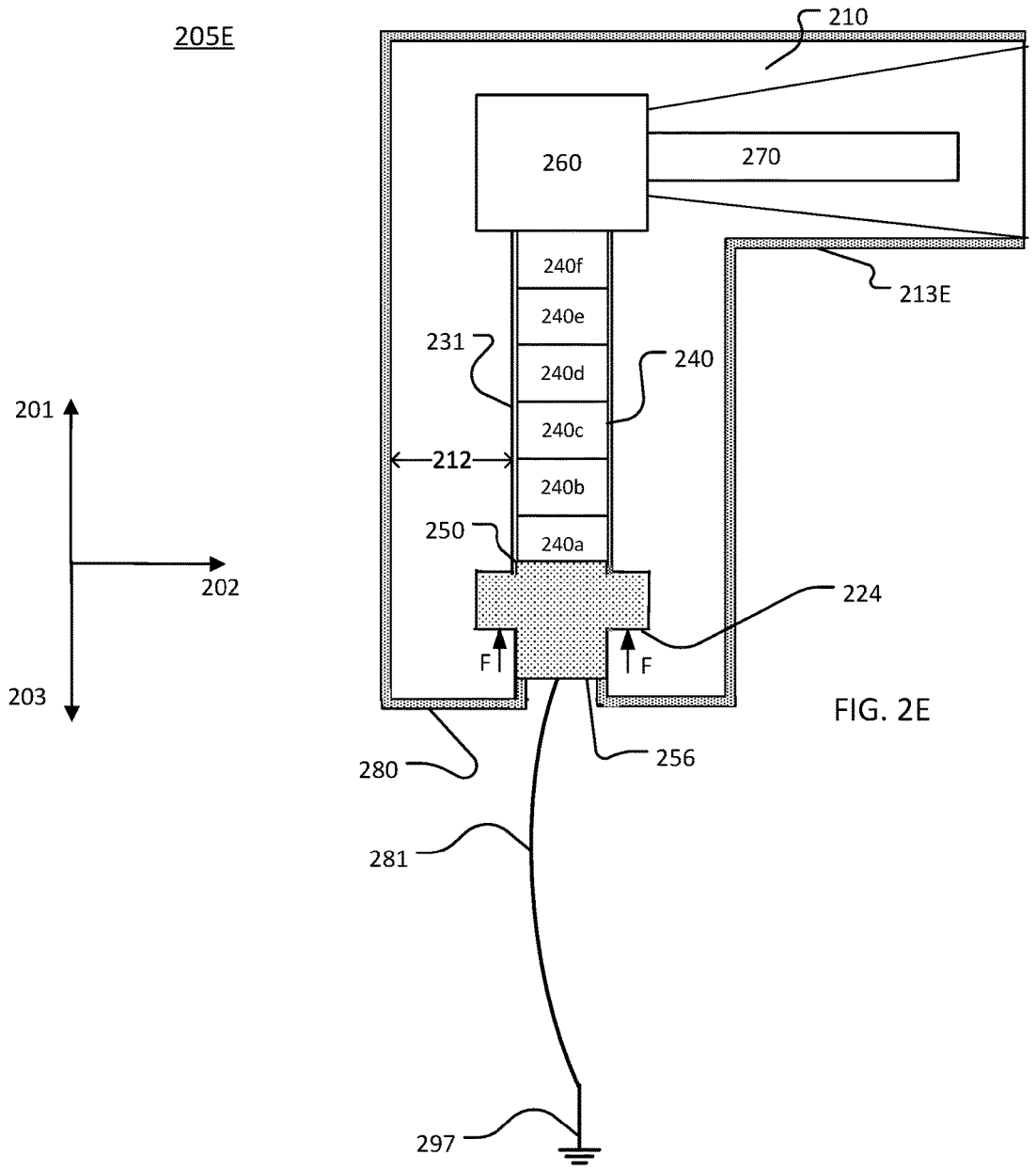

In some implementations, the conductive connection 280 is formed from the conductive shell 213. FIG. 2E, which is a block diagram of another example electrical connector 205E, shows an example of such an implementation. The electrical connector 205E is the same as the electrical connector 205 except that, in the electrical connector 205, the conductive shell 213 extends along the end 206 of the insulating housing and makes physical contact with the plug 250. Because the conductive shell 213 and the plug 250 are electrically conductive, the physical connection between the conductive shell 213 and the plug 250 forms the conductive connection 280. Thus, in these implementations, the conductive connection 280 is the conductive shell 213 itself, and the wire 281 connects the plug 250 to ground 297. The electrical component 240 is connected to ground 297 through the plug 250 and the wire 281. The plug 250 and the wire 281 are metallic and can carry large currents (such as 10 kA and greater). In implementations in which the conductive shell 213 is made from a conductive rubber, the plug 250 and the wire 281 can carry larger amounts of current than the conductive shell 213 without burning or otherwise degrading, and connecting the plug 250 directly to ground 297 through the wire 281 may result in safer and/or more efficient operation.

Regardless of the configuration of the conductive connection 280 and the wire 281, the conductive shell 213 is connected to ground 297, removing or reducing the risk of electrical shock to an operator.

In the example of FIGS. 2A and 2B, the groove 220 has a rectangular shaped cross-section in a plane defined by the directions 201 and 202. However, in other implementations, the groove may have a different configuration.

Figure 3A:
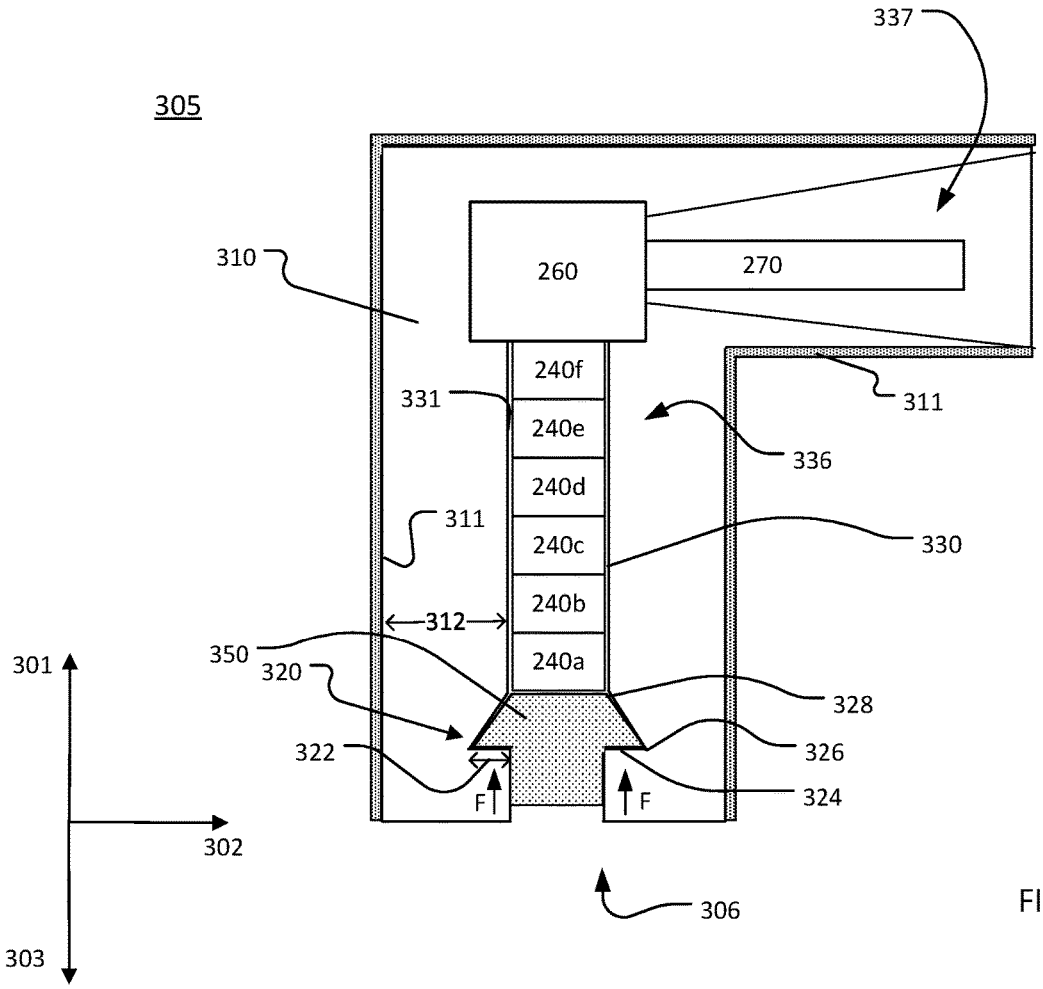
FIG. 3A is a side cross-sectional block diagram of another example electrical connector.

Referring to FIG. 3A, a side cross-sectional block diagram of another example electrical connector 305 is shown. The electrical connector 305 includes an insulating housing 310, which is surrounded by a conductive shell 311. The insulating housing 310 has an inner wall 331 that defines a cavity 330 and a groove 320. The electrical component 240 (shown as the blocks 240*a*-240*f*) is in a first portion 336 of the cavity 330, and the electrical conductor 270 is in a second portion 337 of the cavity 330. The electrical conductor 270 and the electrical component 240 are electrically connected by the contact assembly 260. The MOV blocks 240*a*-240*f* are held in contact by a force F, which acts along a direction 301. The force F is provided by the interaction of a plug 350 and the groove 320 of the insulating housing 310.

The insulating housing 310 is similar to the insulating housing 210 except for the shape of the groove 320. As discussed below, the configuration of the plug 350 and the groove 320 may allow the plug 350 to be more easily inserted into the cavity 330. Similar to the insulating housing 210, the insulating housing 310 and the plug 350 interact to provide a force that is sufficient to hold the MOV blocks 240*a*-240*f* in physical contact with each other and against the contact assembly 260 without using other compression mechanisms.

The groove 320 has a first groove end 326 and a second groove end 328. Of the first groove end 326 and the second groove end 328, the first groove end 326 is closer to a first end 306 of the insulating housing 310. The groove 320 extends radially into the insulating housing 310, with the first groove end 326 extending to a groove depth 322. The portion of the groove 320 between the second groove end 328 and the first groove end 326 extends radially into the insulating housing to a depth than is less than the groove depth 322.

Figure 3B:
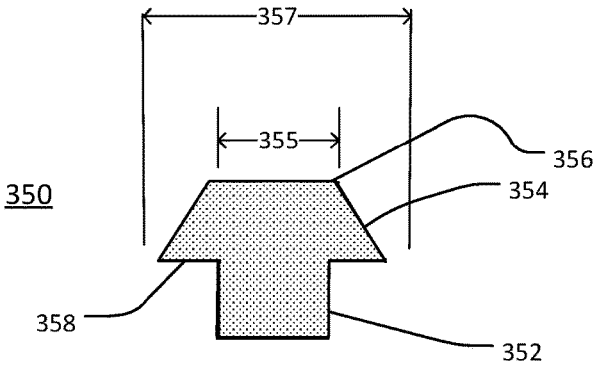
FIG. 3B is a side cross-sectional block diagram of an example plug for the electrical connector of FIG. 3A.

FIG. 3B is a side block diagram of the plug 350. The plug 350 includes a body 352 and a projection 354, which extends radially from the body 352. The projection 354 has a partial cone shape. The projection 354 has a first width 355 at a first end 356 and a second width 357 at a second end 358. The first width 355 is smaller than the second width 357, and the projection 354 has a trapezoidal shaped cross-section.

The groove 320 is shaped to receive the projection 354. As discussed above, at the first groove end 326, the groove 320 extends into the insulating housing 310 radially to the groove depth 322. Because the first end 356 of the projection 354 has a smaller width than the second end 358 of the projection 354, the plug 350 may be more easily inserted into the cavity 330 and the groove 320.

When the projection 354 is in the groove 320, a groove wall 324, which is the portion of the inner wall 231 that is at the first groove end 326, makes contact with the second end 358 of the projection 354. The groove wall 324 applies a force in the direction 301 to the second end 358 of the projection 354 when the insulating housing 310 contracts in the direction 301. This force also results in the first end 356 of the projection 354 applying a force to the electrical component 240 in the direction 301. The insulating housing 310 has a thickness 312, which may be, for example, greater than 1.3 cm, greater than 1.9 cm, or between 1.95 and 2 cm. Similar to the example discussed in FIGS. 2A and 2B, the relatively large thickness 312 and the groove depth 322 allow a cooperation between the groove 320 and the plug 350 that results in the application of 50 lbs or more of force on the plug 350 in the direction 301. Thus, the electrical component 240 is compressed in the axial direction by the interaction of the insulating housing 310 and the plug 350.

Figure 4:
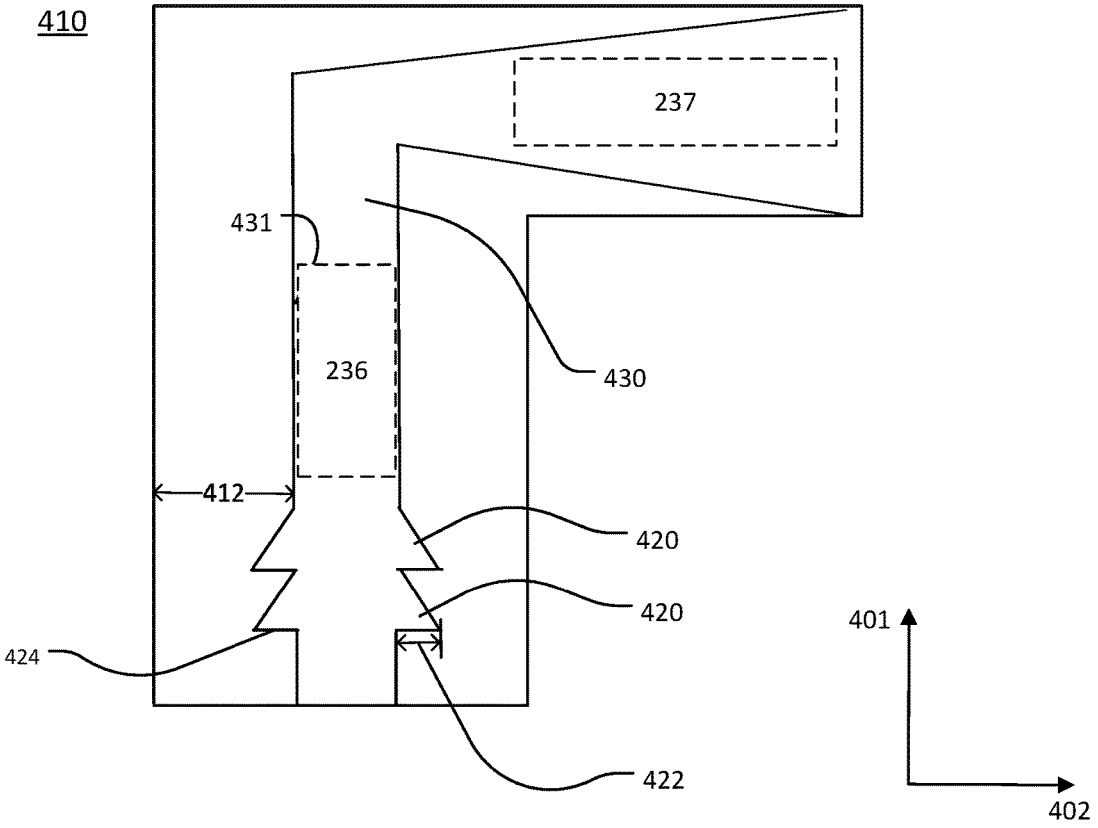
FIG. 4 is a side cross-sectional block diagram of another example insulating housing for an electrical connector.

Referring to FIG. 4, a side cross-sectional block diagram of another example an insulating housing 410, which may be used as in the electrical connectors 105 (FIG. 1), 205 (FIG. 2A), or 305 (FIG. 3A) instead of the insulating housings 110, 210, and 310, respectively. The insulating housing has a thickness 412 and an inner wall 431. The thickness 412 may be, for example, greater than 1.3 cm, greater than 1.9 cm, or between 1.95 and 2 cm. The inner wall 431 defines a cavity 430, which has a first portion 436 that extends in a direction 301 and a second portion 437 that extends in a direction 302.

The insulating housing 410 is similar to the insulating housings 210 (FIGS. 2A and 2B) and 310 (FIG. 3), except that the inner wall 431 of the insulating housing 410 defines a plurality of grooves 420 that extend into the insulating housing 410. Each of the grooves 420 has a groove wall 424 that extends into the insulating housing 410 to a groove depth 422. The plurality of grooves 420 may all have the same shape and size cross-section in a plane defined by the directions 301 and 302, or the grooves 420 may have different shapes and cross-sections.

When the insulating housing 410 is assembled into an electrical connector, each of the plurality of grooves 420 receives a plug (such as the plug 350 of FIG. 3B), and an electrical component (such as the electrical component 240) is held in the first portion 436 of the cavity 430 by a force generated by the cooperation of the plugs and the grooves 420. The amount of force applied to the electrical component 240 may be increased by using a configuration with multiple plugs and grooves.

The electrical connectors 205, 205E, and 305 are shown as an elbow connectors with an opening and a bushing for connection to a high-power electrical system at one end (for example, the end 208 of the electrical connector 205). However, groove configurations and housing thicknesses such as discussed with respect to electrical connectors 205, 205E, and 305 may be used with other forms of electrical connectors. For example, such a housing and groove may be used in a T-body electrical connector.

Referring to FIG. 5, a side cross-sectional block diagram of another example electrical connector 505 is shown. The electrical connector 505 is similar to the electrical connector 205, except the electrical connector 505 is a T-body electrical connector. A T-body electrical connector may include a portion with two openings, and another portion that extends perpendicularly and includes a surge arrestor (such as a plurality of MOV disks).

The electrical connector 505 includes an insulating housing 510, which has an outer surface 511 and an inner wall 531. The insulating housing 510 has a thickness 512, measured between the outer surface 511 and the inner wall 531 in the direction 502. The inner wall 531 defines a groove 520. The groove 520 includes a groove wall 524, which extends into the insulating housing 510 to a groove depth 522. In the example of FIG. 5, the plug 350 (FIG. 3B) is received in the groove 520. In other examples, the cross-section of the groove 520 may be different, and a plug of a different shape (such as the plug 250 of FIG. 2C) may be received in the groove 520. The electrical component 240 is held in the cavity 530, and is electrically connected to the electrical conductor 270 at the contact assembly 260.

The electrical connector 505 includes a first portion 536 and a second portion 537. The first portion 536 extends perpendicularly from the second portion 537. The second portion 537 has two openings, an opening 508 and an opening 509, which is on an end of the second portion 537 opposite to an end that defines the opening 508. The ends 508 and 509 may be an opening that forms a bushing that also may be connected to, for example, a high-voltage electrical system or to measurement equipment.

Figure 6:
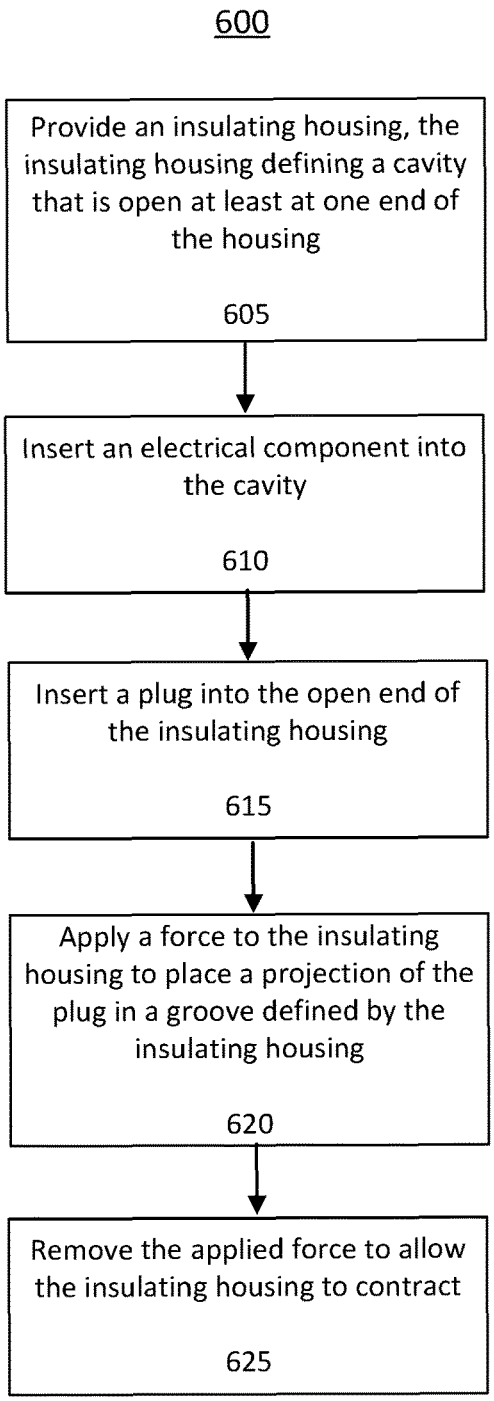
FIG. 6 is a flow chart of an example process for assembling an electrical connector.

Referring to FIG. 6, a flow chart of an example process 600 for assembling an electrical connector is shown. The process 600 is discussed with respect to the electrical connector 205 of FIG. 2B. However, the process 600 may be used to form other electrical connectors. For example, the process 600 may be used to assemble the electrical connector 305 of FIG. 3A.

The insulating housing 210 is provided (605). As shown in FIG. 2A, the insulating housing 210 has an inner wall 231, which defines a cavity 230 and a groove 220. The groove 220 radially extends from the cavity 230 into the insulating housing to a groove depth 222. The insulating housing 210 is open at the ends 206 and 208. Additionally, the insulating housing 210 is made from a non-conductive material that expands along the direction 203 when a force in the direction 203 is applied. The material of the insulating housing 210 contracts along the direction 201 when the applied force is removed. The insulating housing 210 may be made from, for example, rubber.

The electrical component 240 is inserted into the cavity 230 (610). The electrical component 240 may be inserted into the cavity 230 at the end 206. The electrical component 240 is held in the cavity 230 by an interference fit. The plug 250 is inserted into the cavity 230 at the end 206 (515). As shown in FIG. 2C, the plug 250 includes a projection 254 that radially extends from the body 252 of the plug 250. The width of the projection 254 (the extent of the projection 254 in the direction 202) is greater than the diameter 232 of the cavity 230. Additionally, the width of the projection 254 is greater than the width of the body 252 (the extent of the body 252.

To place the projection 254 in the groove 220, an expanding force is applied to the insulating housing 210 in the direction 203 and toward the end 206 (620). Prior to the expanding force being applied, the insulating housing 210 is in a resting state and is not elongated. The expanding force may be applied to the insulating housing 210 by, for example, pulling the insulating housing 210 in the direction 203. The expanding force also may be applied in the direction 202. The insulating housing 210 expands along the direction that the expanding force is applied such that the groove 220 fits over the projection 254.

When the projection 254 is received in the groove 220, the expanding force is removed from the insulating housing 210 (625). Removing the expanding force causes the insulating housing 210 to contract in the direction 201 (opposite to the direction 203). However, due to the placement of the electrical component 240 and the plug 250 in the cavity 230, as well as the relative size of the housing 210, the housing 210 does not contract fully to the non-elongated condition of the housing prior to the application of the expansion force. Instead, the housing 210 remains elongated by, for example 10-30% more as compared to the non-elongated, resting condition. For example, the portion 216 of the housing 210 may remain 20-30% elongated, or elongated as compared to the non-elongated, resting condition. Because the portion 216 of the housing 210 remains elongated, the housing 210 continues to contract in the direction 201, thereby applying the force F on the projection 254 of the plug 250. In other words, the contraction in the direction 201 causes the groove wall 224 to apply the force F (FIG. 2B) to the projection 254. The force F acts along the direction 201. The force F is at least 35 lbs. For example, the force F may be 35 to 200 lbs, 50 to 100 lbs, 100 to 200 lbs, or the force F may be greater than 200 lbs. Additionally, the insulating housing 210 may contract radially inward, compressing the electrical component 240 radially and improving the interference fit between the inner wall 231 and the electrical component 240.

Further, the insulating housing 210 is placed in the conductive shell 213. For example, the conductive shell 213 may be molded into an elbow shaped body or a T-shaped body. The semiconductive insert 262 also may be formed by molding and placed in the conductive shell 213. The material that forms the insulating housing 210 may be injected into the conductive shell 213 such that the insulating housing 210 fills the region between the conductive shell 213 and the semiconductive insert 262. Additionally, the insulating housing 210 occupies the region between the conductive shell 213 and the electrical component 240.

Other features are within the scope of the claims. For example, the insulating housing 410 is shown as having two grooves 420. Other implementations may have more grooves 420. For example, three or four grooves may be used. The insulating housings 210 and 310 may include more than one groove 220 and 320, respectively.

The insulating housings 210 and 310 of the electrical connectors 205 and 305, respectively, are shown as having portions that extend along perpendicular directions. However, other configurations are possible and the portions may extend along directions that are different but not perpendicular.

The electrical connectors 205 and 305 include the electrical component 240, which is a collection of MOV blocks 240*a*-240*f* stacked along the directions 201 and 301, respectively. However, other electrical components may be used in the electrical connectors 205 and 305. For example, the electrical component 240 may include any number of MOV blocks, and may include more or fewer MOV blocks than shown in FIGS. 2B and 3A. In some implementations, the electrical component 240 may be a single MOV, and the cooperation between the plug 250, 350 and the respective groove 220, 320 provides a longitudinally compressive force that may help to ensure that the single MOV remains intact and operates properly.

In some implementations, the conductive shell 213 may be, for example, a metallic coating that is placed on the outer surface 211 of the insulating housing or a metallic material placed on the outer surface 211.

What is claimed is:

1. An electrical connector comprising:

an insulating housing comprising an inner wall, a first end, and a second end, the inner wall of the insulating housing defining a cavity and a groove, the groove comprising a groove wall, the groove wall extending from the cavity radially in more than one direction into the insulating housing to a groove depth, the insulating housing comprising a material configured to expand and contract, wherein the cavity comprises a first cavity portion that extends along a first direction, and a second cavity portion that extends along a second direction;

an electrical component in the cavity;

a semiconductive insert in the cavity between the first cavity portion and the second cavity portion;

a connection junction electrically connected to the electrical component, wherein the semiconductive insert and the connection junction are directly connected by an adhesive bond to fluidly seal the first cavity portion from the second cavity portion;

an electrically conductive shell at an outer surface of the insulating housing, the electrically conductive shell comprising a conductive elastomeric material; and a plug in the insulating housing, the plug comprising a body and projection that radially extends outward from the body in more than one direction, the projection being received in the groove, wherein the groove wall applies more than 35 pounds (lbs) of force on the projection of the plug in a direction that is toward the electrical component, the groove wall comprises a radially extending portion of the inner wall of the insulating housing, the radially extending portion of the inner wall of the insulating housing makes physical contact with the projection of the plug and applies the force to the projection of the plug, and the direction toward the electrical component comprises an axial direction.

2. The electrical connector of claim 1, wherein the groove wall applies more than 70 lbs of force on the plug in the direction.

3. The electrical connector of claim 1, wherein the groove wall applies between 70 and 200 lbs of force on the plug in the direction.

4. The electrical connector of claim 1, wherein the projection of the plug has a partial cone shape and a trapezoidal cross-section.

5. The electrical connector of claim 1, wherein the electrical component comprises a plurality of metal oxide varistors (MOVs), the MOVs being held in direct physical contact with each other by the force.

6. The electrical connector of claim 5, wherein the electrical component lacks an additional mechanism that holds the MOVs in physical contact with each other.

7. The electrical connector of claim 1, wherein the electrical connector further comprises an electrical contact that is electrically connected to the electrical component, the electrical contact being configured to connect to a high-power electrical system, the electrical contact extends into the second cavity portion and toward the second end of the insulating housing, and the electrical component is in the first cavity portion.

8. The electrical connector of claim 1, wherein the insulating housing has a thickness in a direction that extends radially from the electrical component, and a ratio of the thickness of the insulating housing to the diameter of the electrical component is at least 0.4.

9. The electrical connector of claim 8, wherein the ratio of the thickness of the insulating housing to the diameter of the electrical component is at least 0.5.

10. The electrical connector of claim 8, wherein the ratio of the thickness of the insulating housing to the diameter of the electrical component is between 0.5 and 0.7.

11. The electrical connector of claim 1, wherein the insulating housing has a thickness in a direction that extends radially from the cavity, and a ratio of the thickness of the insulating housing to the groove depth is less than 3.

12. The electrical connector of claim 11, wherein the ratio of the thickness of the insulating housing to the groove depth is 2.3-2.6.

13. The electrical connector of claim 1, wherein the insulating housing defines one or more additional grooves spaced along the axial direction, each of the one or more additional grooves comprising a respective groove wall that extends radially from the cavity into the insulating housing in more than one direction, and the plug comprises one or more additional projections, and one of the one or more additional projections of the plug is received in each of the one or more additional grooves.

14. The electrical connector of claim 1, further comprising an electrically conductive connection between the plug and the electrically conductive shell.

15. A method of assembling an electrical connector, the method comprising:

providing an insulating housing, the insulating housing comprising a material that expands under applied force and contracts when the applied force is removed, the insulating housing defining a cavity that is open at least at one end of the insulating housing and a groove radially extending from the cavity into the insulating housing in more than one direction, the cavity comprising a first cavity portion that extends along a first direction, and a second cavity portion that extends along a second direction;

inserting an electrical component into the cavity;

inserting a semiconductive insert in the cavity between the first cavity portion and the second cavity portion;

electrically connecting a connection junction to the electrical component;

directly connecting the semiconductive insert and the connection junction by an adhesive bond to fluidly seal the first cavity portion from the second cavity portion;

inserting a plug into the open end of the insulating housing, the plug comprising a body and a projection that extends from the body in more than one direction, the projection having a first width and a second width, the first width being larger than a diameter of the cavity and larger than the second width; and applying a force to the insulating housing to place the projection of the plug in the groove, the force being in a first direction that is parallel to a longitudinal axis of the cavity and toward the first opening, and the force expanding the insulating housing in the first direction;

removing the applied force to allow the insulating housing to contract in a second direction that is away from the first opening such that a radially extending portion of the groove exerts force on the plug in the second direction to hold the electrical component in the cavity, wherein the radially extending portion of the groove exerts between 35 and 200 pounds (lbs) of force on the plug in the second direction.

16. The method of claim 15, further comprising:

placing the insulating housing inside an electrically conductive shell; and electrically connecting the plug to the electrically conductive shell through an electrically conductive connection.

17. An electrical connector comprising:

an insulating housing comprising an inner wall, a first end, and a second end, the inner wall of the insulating housing having a thickness and defining a cavity and a groove, the groove comprising a groove wall that extends from the cavity radially in more than one direction to a groove depth, the insulating housing comprising a material configured to expand and contract, wherein the cavity comprises a first cavity portion that extends along a first direction, and a second cavity portion that extends along a second direction;

an electrical component in the cavity;

a semiconductive insert in the cavity between the first cavity portion and the second cavity portion;

a connection junction electrically connected to the electrical component, wherein the semiconductive insert and the connection junction are directly connected by an adhesive bond to fluidly seal the first cavity portion from the second cavity portion;

an electrically conductive shell at an outer surface of the insulating housing, the electrically conductive shell comprising a conductive elastomeric material; and a plug in the housing, the plug comprising a body and projection that radially extends outward from the body in more than one direction, the projection being received in the groove, wherein the thickness of the insulating housing is at least 1.3 centimeters, and the ratio of the insulating housing to a radius of the electrical component is at least 0.4.

18. The electrical connector of claim 17, wherein the thickness of the insulating housing is at least 1.9 centimeters.

19. The electrical connector of claim 17, wherein a ratio of the thickness of the insulating housing to a diameter of the electrical component is greater than 0.5.

20. The electrical connector of claim 17, wherein a ratio of the thickness of the insulating housing to a diameter of the electrical component is greater than 0.55.

21. The electrical connector of claim 17, wherein the electrical component in the cavity comprises a plurality of MOVs, and the groove wall applies a force to the plug in an axial direction, the force holding the MOVs in physical contact with each other.

22. An electrical connector comprising:

an insulating housing comprising an inner wall and an outer surface, the insulating housing having a thickness between the inner wall and the outer surface, the inner wall of the insulating housing defining a cavity, the insulating housing comprising a material configured to expand and contract, the material being associated with a resting state and being configured to elongate in a longitudinal direction relative to the resting state, wherein the cavity comprises a first cavity portion that extends along a first direction, and a second cavity portion that extends along a second direction;

an electrical component in the cavity, the electrical component having a diameter in a direction that is perpendicular to the longitudinal direction;

an electrical conductor configured to connect to a high-voltage electrical system;

an electrically conductive shell at the outer surface of the insulating housing, the electrically conductive shell being configured to connect to ground, the electrically conductive shell comprising a conductive elastomeric material;

a semiconductive insert in the cavity between the first cavity portion and the second cavity portion;

a connection junction electrically connected to the electrical component and to the electrical conductor, the insulating housing being between the connection junction and the electrically conductive shell, the semiconductive insert and the connection junction being directly connected by an adhesive bond to fluidly seal the first cavity portion from the second cavity portion; and an electrically conductive plug in the housing, the plug comprising a body and a projection that extends radially outward from the body in more than one direction, the projection being electrically connected to the electrical component and being configured to connect to ground, wherein a portion of the housing is elongated at least 10% more than the resting state, and a ratio of the thickness of the housing to the diameter of the electrical component is greater than 0.4.

23. The electrical connector of claim 22, wherein the plug applies a force that is greater than 35 lbs on the electrical component, the applied force being toward the semiconductive insert.

24. The electrical connector of claim 23, wherein the electrical component comprises a plurality of MOVs, the MOVs being held in direct physical contact with each other by the force, and the electrical component lacks an additional mechanism that holds the MOVs to each other.

25. The electrical connector of claim 22, wherein the ratio of the thickness of the housing to the diameter of the electrical component is greater than 0.5.

26. The electrical connector of claim 22, wherein the ratio of the thickness of the housing to the diameter of the electrical component is between 0.55 and 0.65.

* * * * *